United States Patent [19]

Binder et al.

[11] Patent Number: 4,995,142

[45] Date of Patent: Feb. 26, 1991

[54] APPARATUS FOR REMOVING FIBER FLOCKS FROM A LINE OF FIBER BALES

[75] Inventors: Rolf Binder, Schottikon, Fed. Rep. of Germany; Daniel Hanselmann, Winterthur, Switzerland

[73] Assignee: Rieter Machine Works, Ltd., Winterthur, Switzerland

[21] Appl. No.: 306,402

[22] Filed: Feb. 3, 1989

[30] Foreign Application Priority Data

Feb. 4, 1988 [CH] Switzerland ..... 00399/88

[51] Int. Cl.[5] ..... D01G 7/00

[52] U.S. Cl. ..... 19/80 R; 19/97; 19/97.5

[58] Field of Search ..... 19/80 A, 80 R, 97, 105, 19/204

[56] References Cited

U.S. PATENT DOCUMENTS

| | | | |
|---|---|---|---|
| 2,938,239 | 5/1960 | Leineweber, Jr. et al. | 19/80 R |
| 3,135,022 | 6/1964 | Binder | 19/80 R |
| 4,493,131 | 1/1985 | Dragagna et al. | 19/80 R |
| 4,712,275 | 12/1987 | Hösel et al. | 19/80 R |

FOREIGN PATENT DOCUMENTS

| | | |
|---|---|---|
| 0130369 | 1/1985 | European Pat. Off. . |
| 1137359 | 9/1962 | Fed. Rep. of Germany . |
| 1491565 | 7/1967 | France . |
| 1503477 | 10/1967 | France . |
| 0383841 | 10/1964 | Switzerland . |
| 481230 | 12/1969 | Switzerland . |

*Primary Examiner*—Werner H. Schroeder
*Assistant Examiner*—Michael A. Neas
*Attorney, Agent, or Firm*—Kenyon & Kenyon

[57] ABSTRACT

The removal roll carrier can be inclined at an angle while the carrier is simultaneously moved vertically and while the removal apparatus moves over the line of fiber bales. This has the advantage that flocks can be removed from the bales not only in the horizontal direction but also in an inclined direction. A microprocessor controls the pivoting of the removal apparatus into a predetermined inclined position while simultaneously moving the removal apparatus vertically during movement of the machine frame along the path of the fiber bales.

9 Claims, 6 Drawing Sheets

I
1
2
3
4
5
6
7
8
9
10
11
12
13
14
15
16
17
18
19
20
21
22
23
24
25
26
27
28
29
30
31
32
33
34
35
36
37
38
39
40
41
45
46
49
50
51
52
62
63
A
L

Fig. 5
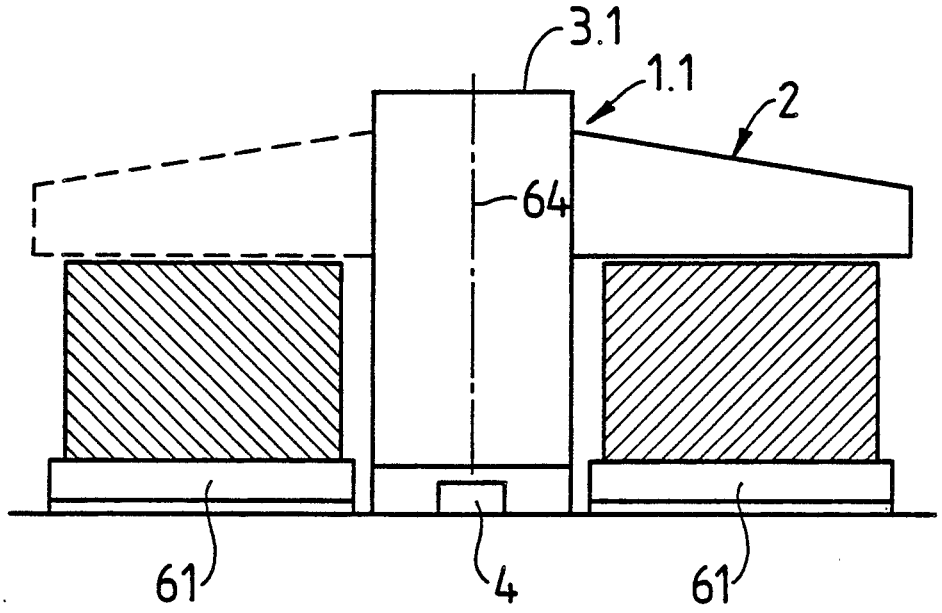
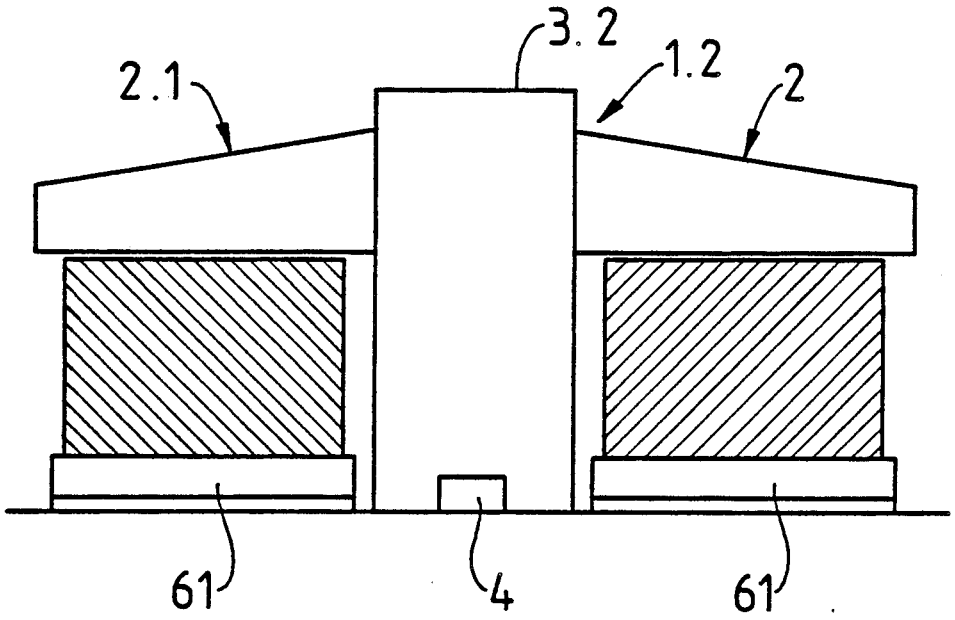
Fig. 6

APPARATUS FOR REMOVING FIBER FLOCKS FROM A LINE OF FIBER BALES

This invention relates to an apparatus for removing fiber flocks from a line of fiber bales.

Heretofore, various types of apparati have been known for the removal of fiber flocks from textile fiber bales arranged in line. For example, European patent application No. 0193647 describes an apparatus having a machine frame adapted to reciprocate along a line of fiber bales with a removal means mounted therein capable of moving up and down and having a rotatable and drivable removal roll therein for the removal of fiber flock from fiber bales. During operation, the removal depth is varied according to the density of the fiber bales in order that substantially the same output is obtained on each reciprocation of the machine frame.

However, it is known per se that fiber bales do not have the same density throughout, even when the steel strapping around the bales has been removed and the bales have been disposed in line. This means that during removal—with a constant removal depth and without varying the removal depth—a lower throughput is obtained than in the middle zone of the bale height in which the density is greater.

Swiss Patent No. 503,809 takes this fact into account by using an inclined type of removal in order to obtain an average of substantially all the fiber bale densities in one passage of the removal means over a line of fiber bales. However, in this case, it is the apparatus itself which performs the inclined travel on correspondingly inclined rails with a predetermined angle of incidence. The feed for determining the removal depth per reciprocation of the removal means of the apparatus is produced by means of a conveyor belt which, after each passage of the removal means, is moved a predetermined step in the direction of the bale material removal means. The disadvantage of this apparatus consists in a lack of flexibility since the removal means can only be moved over the bales in one predetermined condition. The same disadvantage applies to the apparatus described in European patent application No. 0193647.

Other types of fiber flock removing devices have also been described in European patent application No. 0130369; German Patent No. 1,137,359; and U.S. Pat. Nos. 3,443,285 and 3,135,022. However, the structures described therein do not compensate for the difference in density of fiber bales aligned in a row during fiber removal.

Accordingly, it is an object of the invention to compensate for differences in density in the bales of a line of fiber bales in a relatively simple manner to obtain a more uniform output.

It is another object of the invention to be able to remove the flocks from a line of fiber bales of different densities in a manner to achieve an average of substantially all the fiber bale densities during one passage of a removal means.

Briefly, the invention provides an apparatus for removing fiber flocks from a line of fiber bales which includes at least one machine frame mounted for reciprocating along a path parallel to a line of bales and at least one fiber removal means mounted in the machine frame for vertical up and down movement over a fiber bale. The removal means includes at least one rotatable and drivable removal roll for removing fiber flock from a respective fiber bale.

In accordance with the invention, the apparatus includes a means for pivoting the fiber removal means about a pivot axis within the machine frame and control means for pivoting the removal means into a predetermined inclined position while simultaneously moving the removal means vertically during movement of the machine frame along the path parallel to the line of bales.

The advantage of the apparatus is that a single apparatus enables flocks to be removed from fiber bales in a purely horizontal direction and/or in an inclined direction. This allows a more versatile use of the apparatus.

These and other objects and advantages of the invention will become more apparent from the following detailed description taken in conjunction with the accompanying drawings, wherein.

Figure 1:
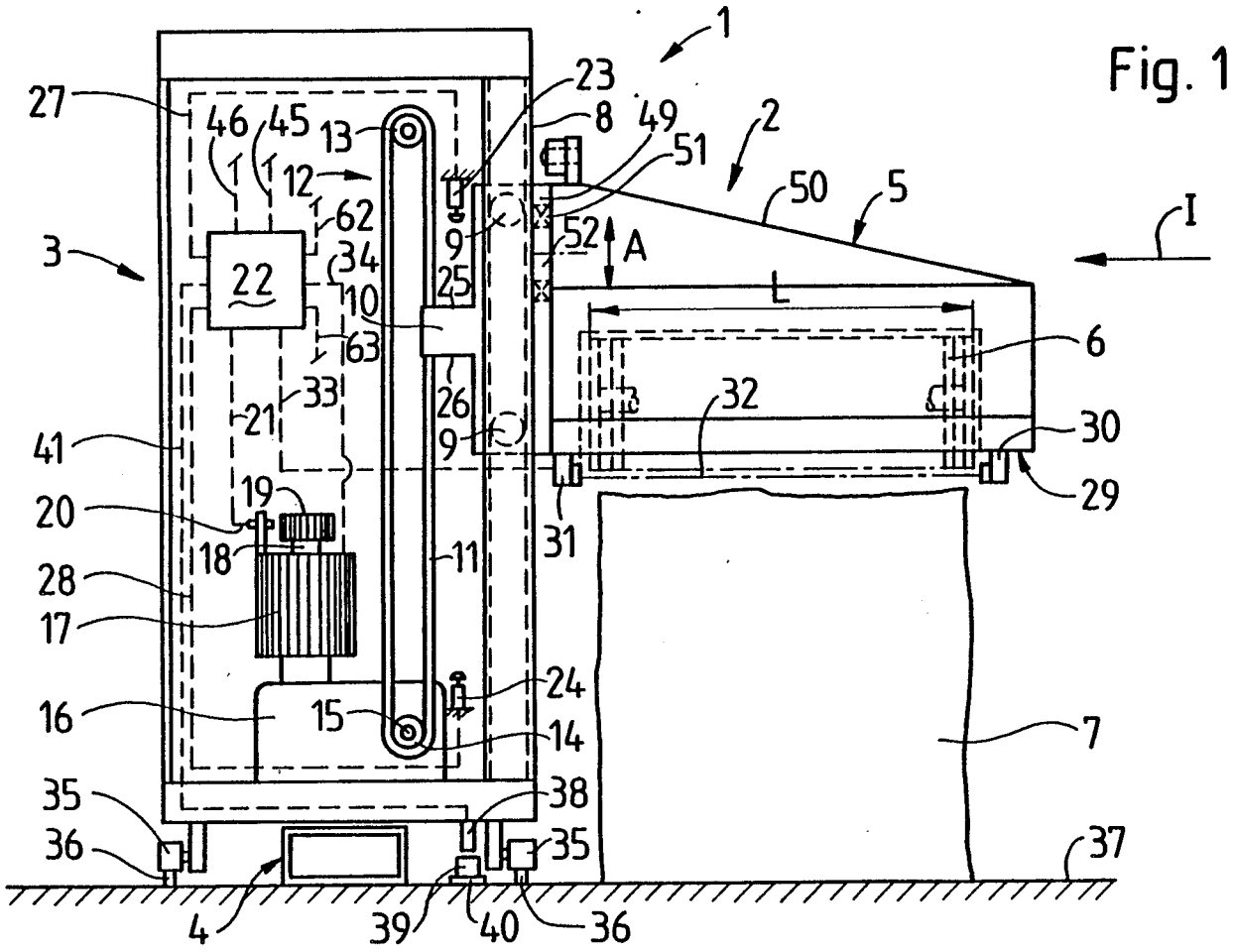
FIG. 1 illustrates a semi-diagrammatic view of a bale material removal apparatus according to the invention.
Figure 2:
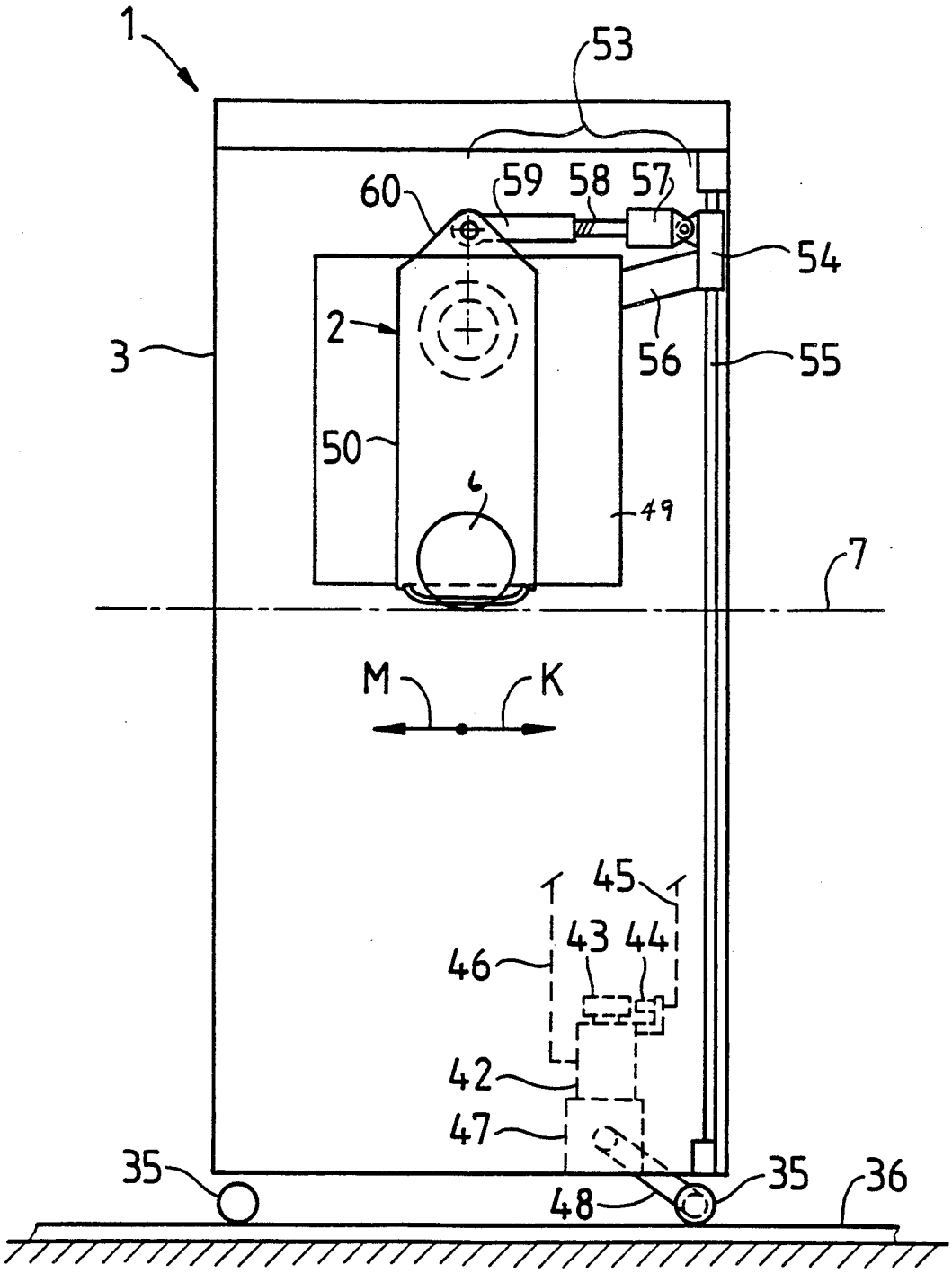
FIG. 2 illustrates a simplified view of the apparatus of FIG. 1 taken in the direction indicated by the arrow I of FIG. 1.
Figure 3:
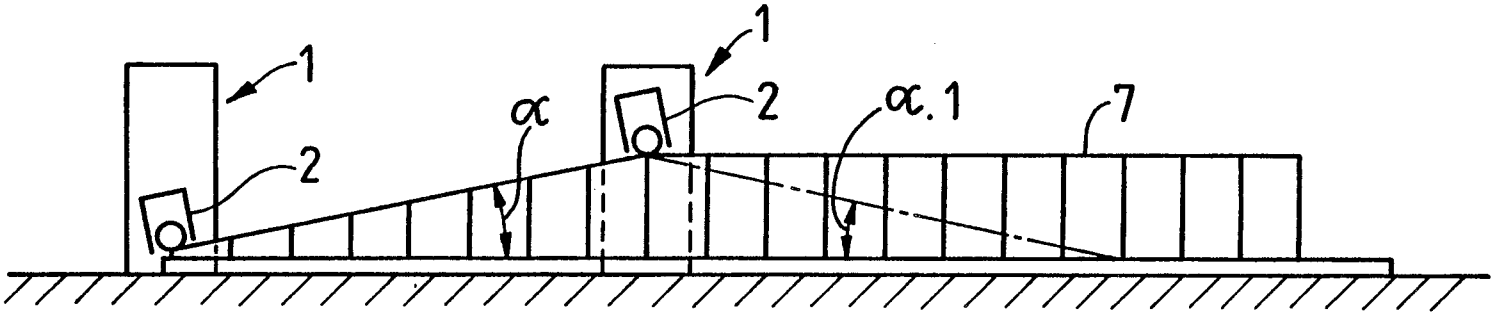
Figure 4:
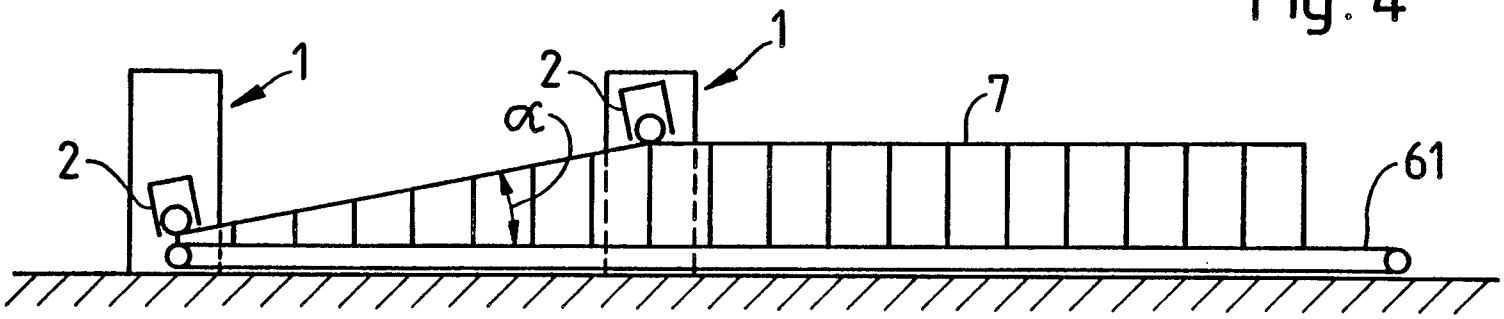
Figure 7:
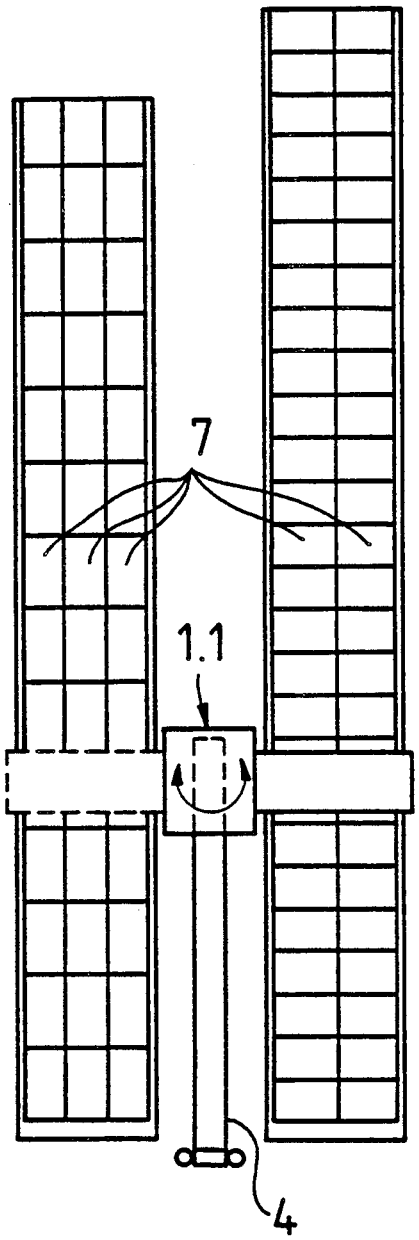
Figure 8:
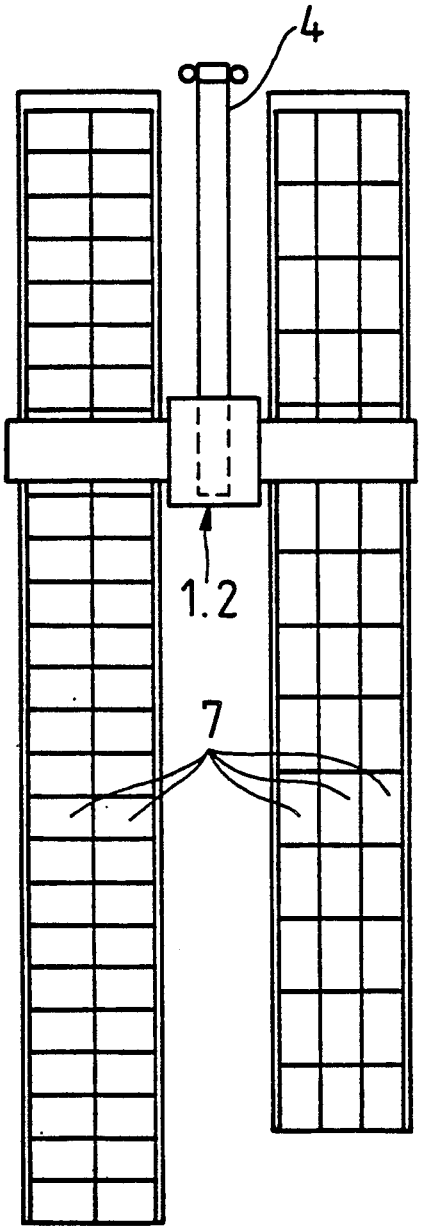
Figure 9:
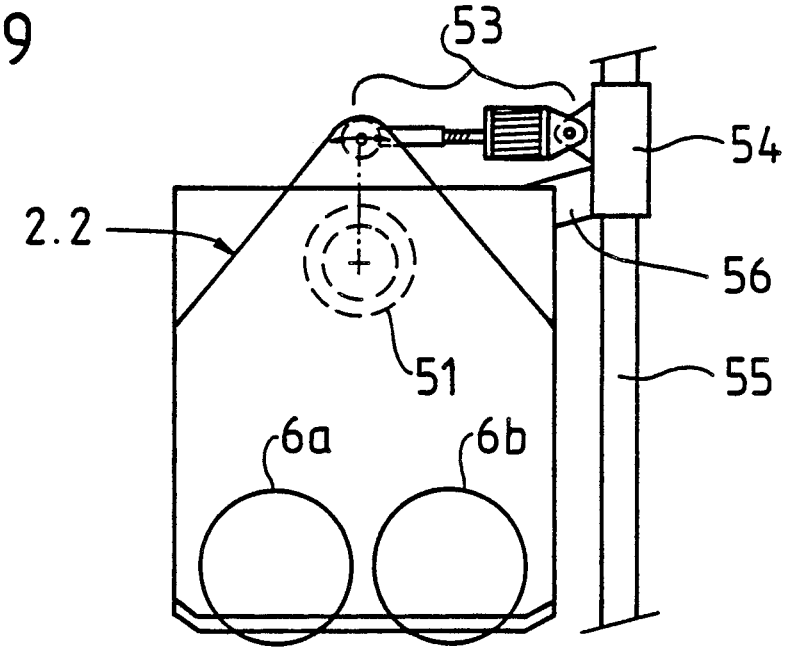
Figure 10:
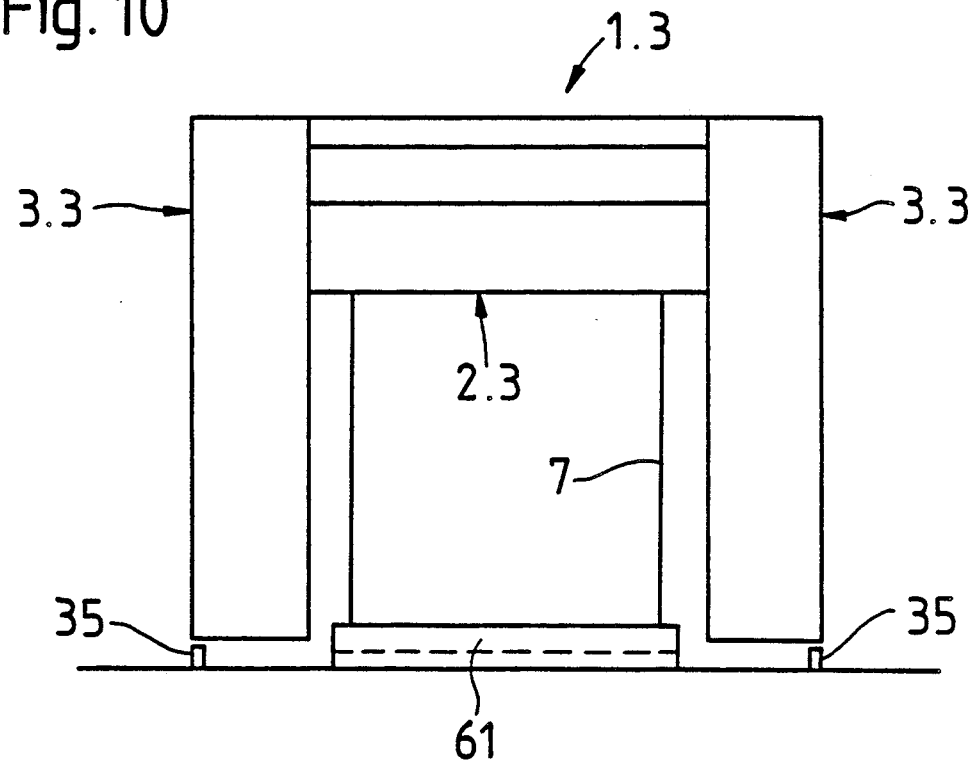

FIG. 3 diagrammatically illustrates the apparatus of FIG. 1 in one mode of operation;

FIG. 4 illustrates the apparatus of FIG. 1 in a second mode of operation;

FIG. 5 illustrates a modified apparatus having a machine frame mounted for pivoting on a vertical axis in accordance with the invention;

FIG. 6 illustrates a view of an apparatus employing a pair of removal means on a common machine frame in accordance with the invention;

FIG. 7 illustrates an apparatus of FIG. 5 movable along multiple parallel rows of fiber bales in accordance with the invention;

FIG. 8 illustrates a top view of an apparatus according to FIG. 6 movable along multiple parallel rows of fiber bales in accordance with the invention;

FIG. 9 illustrates a variant of a detail of the apparatus of FIG. 2 to an enlarged scale; and FIG. 10 illustrates a variant of the apparatus according to the invention of FIG. 1.

The apparatus for removing fiber flocks comprises a removable means 2, a machine frame 3 and a flock conveyor 4.

The removal means 2 comprises a housing structure 5 in which a rotating removal roll 6 is drivably mounted to remove fiber flocks from a line of fiber bales 7. The housing structure 5 is constructed to receive the fiber flocks removed from the fiber bales 7 and to feed them on, in a manner not shown, to the flock conveyor 4.

The housing structure 5 is movable up and down in the direction indicated by the arrow A by means of rollers 9 rotatably secured thereto and guided in guide rails 8 of the machine frame 3. FIG. 1, however, shows only one pair of rollers 9 and only one rail 8; the rollers and rail provided in the same way on the opposite side are not visible.

The housing structure 5 also contains: a driver 10 rigidly connected to a chain 11 of a chain drive 12.

The chain drive 12 also comprises a top rotatably mounted chain wheel 13 for reversing the chain 11 and a bottom chain wheel 14 for driving the chain 11. The bottom chain wheel 14 is shrunk onto a drive shaft 15 of a transmission 16 so as to rotate therewith. An electric motor 17 connected to the transmission 16 and constructed as a stepping motor serves as the power source for the transmission.

The chain drive 12, the transmission 16 and the electric motor 17 are referred to as a lifting mechanism, taken as a unit. A gearwheel 19 is shrunk on the top shaft end 18, as viewed, so as to rotate with the shaft end and functions as a counting wheel together with an initiator 20 as a pulse transmitter, the pulses thereof being fed via a line 21 to a microprocessor 22. The initiator 20 is of conventional commercial type and delivers a pulse on each passing tooth of the gearwheel 19. The initiator 20 is stationary.

A top limit switch 23 and a bottom limit switch 24 are provided on the machine frame 3 to sense the top and bottom end positions of the removal means 2.

The top limit switch 23 is actuated by a top surface 25 and the bottom line switch 24 by a bottom surface 26 of the driver 10. The top limit switch 23 delivers its pulse to the microprocessor 22 via a line 27 and the bottom limit switch 24 delivers its pulse to the microprocessor 22 via a line 28.

A photoelectric barrier comprising a transmitter 30 and a receiver 31 is also provided on the underside 29 of the housing structure 5 facing the fiber bales 7, and is so disposed that the transmitter 30 generates a beam of light 32 extending at least over the entire lengh L of the removal roll 6, the beam of light being converted in the receiver 31 to a signal which is fed to the microprocessor 22 via a line 33.

Another line 34 connects the electric motor 17 to the microprocessor 22.

By means of drivable wheels 35 fixed to the machine frame 3, the latter is arranged to be mobile on rails 36 secured on the spinning shop floor 37, along the fiber bales 7 in the directions of travel K and M (FIG. 2) and across the flock conveyor 4.

For the drive of one of the pairs of wheels 35 (the shaft of this pair is not shown), a stepping motor 42 in the machine frames is also connected to a transmission 47 which drives the pair of wheels 35 (FIG. 2) via an overdrive 48.

The gearwheel 43 is provided on the outwardly directed shaft end of the stepping motor 42 and an initiator 44 is provided on the stepping motor 42 itself. The initiator 44 is connected via a line 45 and the electric motor 42 is connected via a line 46 to the microprocessor 22. As already mentioned previously in connection with the lifting movement of the removal means 5, the initiator 44 serves to count the teeth passing thereby in order to detect the position of the apparatus by means of the microprocessor 22.

Referring to FIG. 2, the removal means 2 is subdivided into two main parts, i.e., a slide 49 on which the driver 10 is fixed (see FIG. 1) and a removal roll carrier 50 which is pivotally mounted by means of a pivot bearing 51 in the slide 49 and a pivot spindle 52 guided in the bearing 51 and forming part of the removal roll carrier 50.

Referring to FIG. 2, a means is also provided in the housing 5 for pivoting the removal roll carrier 50. This means includes a drive mechanism 53 which is connected to a shoe 54 movable up and down on a stationary rail 55. The shoe 54 is, in turn rigidly secured to the slide 49 by means of a web 56.

The drive mechanism 53 consists of a servomotor 57 having a shaft 58 with a screwthread and a threaded bush 59 in which the shaft 58 is guided. The servomotor 57 is pivotable on the shoe 54 and the threaded bush 59 is pivotable on a pivot bearing 60 fixed on the removal roll carrier 50.

The term servomotor denotes a motor capable of exactly determining the rotary movement of the shaft 58 and transmitting the determined motion as a signal to the microprocessor 22 shown in FIG. 1. The removal roll carrier 50 may thus be pivoted into a predetermined inclined position (shown in FIGS. 3 and 4) by means of a preselected number of rotations of the shaft 58. In an inclined position of this kind, flocks are removed from the fiber bales 7 disposed in line as shown in FIG. 3 or 4.

To carry out this removal operation, the microprocessor 22 coordinates the signals from lines 21 and 45 and correspondingly controls the motors 17 and 42 via the lines 34 and 46. Thus, the microprocessor 22 acts as a control means for pivoting the removal means 2 into a predetermined inclined position while simultaneously moving the removal means 2 vertically during movement of the machine frame 1 along the path of the fiber bales 7.

Inclined removal of material as shown in FIGS. 3 and 4 will be carried out basically between the removal angles $\alpha$ of 0° to 60°. Larger angles, i.e. more than 60° are possible, however Alternatively, the removal roll carrier 50 may be pivoted onto the opposite side, looking from the vertical, in order to obtain an inclined position with the angle $\alpha$ 0.1 (FIG. 3). Thus, the removal apparatus can be used for flock removal at an angle not only in one direction but, as shown in FIG. 3, in two opposite inclined directions.

Referring to FIG. 1, to position the machine frame 3 in the end positions and in the respective positions between individual groups of bales 7 if more than one group is to be opened in the double inclined removal system shown in FIG. 3, an initiator 38 is provided on the underside of the machine frame 3 and positioning elements 39 are provided over the entire length of the path on which the apparatus 1 is mobile. These elements 39 are arranged for displacement on a rail 40. The presence of these positioning elements 39 is detected by the initiator 38 and transmitted to the microprocessor via a line 41.

FIG. 4 also shows that the removal means 2 cooperates with a conveyor belt 61 on which the fiber bales 7 are arranged in line for material removal. The conveyor belt 61 also comprises a stepping motor with a geared motor and gearwheel, and an initiator (the complete drive unit is not shown), as already described for the lifting movement of the removal means 2 and for the travel of the machine frame 3. The initiator signals are also fed to the microprocessor via a line 62 (shown only in FIG. 1), which delivers the power signals via line 63 (FIG. 1) to the conveyor belt stepping motor 17.

When the variant shown in FIG. 4 is in operation, the removal means 2 moves back a locally determined distance because the fiber bales 7 are each supplied by the conveyor belt 61 by an amount corresponding to the required material-removal depth.

The advantage of this variant is that continuous operation is possible because the conveyor belt 61 can be "refilled" with new bales.

Of course with the variants shown in FIGS. 3 and 4, it is possible to obtain only small quality mixtures by means of different fiber bales, for example only every other bale may have a quality differing from the first bale.

This disadvantage can be remedied by the arrangements shown in FIGS. 5 and 6 in which, as shown in FIG. 5, the machine frame 3.1 together with the removal means 2 is automatically rotatable about a pivot spindle 64 in the manner konwn, for example, from German patent No. 3208346, this feature requiring appropriate adjustment of the machine frame 3.1 and of the microprocessor. For the sake of simplicity, the mechanical components required for rotatability of the machine frame 3.1 are not shown in FIG. 5.

FIG. 6 shows a variant which is simple in terms of control, but which requires more components, since the machine frame 3.2 comprises two removal means 2, 2.1 respectively disposed in line but projecting in opposite directions, so that a mixture with four qualities can be obtained in the case of material removal in an inclined direction if every other bale has a quality differing from the first bale.

FIG. 7 and 8 show even further-reaching arrangements of fiber bales, a plurality of qualities being simultaneously removable. FIG. 7 shows the pivotability of the machine frame 3.1 according to FIG. 5 and FIG. 8 shows the double removal arrangement with the machine frame 3.2 shown in FIG. 6.

FIG. 9 shows a removal means 2.2 having two removal rolls *6a*, and *6b*. Otherwise, the functions are the same as shown in FIG. 2, so that elements having like functions have like references in FIG. 9.

FIG. 10 also shows that portal arrangements can be used in which two machine frames 3.3 are each arranged to be mobile on rails (not shown) by means of wheels 35, the two frames being connected by a removal means 2.3. Removal may be carried out as shown in FIG. 3 or 4. The functions for a portal arrangement of this kind are the same as for a removal apparatus having a removal means on one side.

The invention thus provides an apparatus for removing fiber flocks from a line of fiber bales to provide an average of substantially all the fiber bale densities of a line of fiber bales during one passage of the apparatus over the bales.

The invention also provides an apparatus which may be adjusted to enable flock removal from fiber bales in a purely horizontal direction and/or in an inclined direction.

What is claimed is:

1. An apparatus for removing fiber flocks from a line of fiber bales, said apparatus comprising:

at least one machine frame mounted for reciprocating along a path parallel to a line of bales;

at least one fiber removal means mounted in said machine frame for vertical up and down movement over a fiber bale, said means including at least one rotatable and drivable removal roll for removing fiber flock from a respective fiber bale;

means for pivoting said fiber removal means about a pivot axis within said machine frame; and control means for pivoting said removal means in said machine frame into a predetermined inclined position while simultaneously and independently moving said removal means vertically during movement of said machine frame along said path.

2. An apparatus as set forth in claim 1 wherein said removal means includes a pair of said removal rolls disposed in parallel relation.

3. An apparatus as set forth in claim 1 wherein said machine frame is pivoted about a vertical axis.

4. An apparatus as set forth in claim 1 which comprises a pair of said removal means mounted on opposite sides of said machine frame.

5. An apparatus as set forth in claim 1 which comprises a pair of said machine frames with said removal means connected therebetween.

6. An apparatus as set forth in claim 1 which further comprises a conveyor belt for moving a line of fiber bales under said removal means.

7. An apparatus as set forth in claim 6 which further comprises means for moving said belt intermittently whereby the depth of removal of material per reciprocation of said removal means is dependent on the feed increment of said conveyor belt.

8. An apparatus as set forth in claim 6 which comprises a pair of said conveyor belts disposed in parallel on opposite sides of said machine frame.

9. An apparatus as set forth in claim 8 which further comprises means for alternately moving said belts in increments.

* * * * *

UNITED STATES PATENT AND TRADEMARK OFFICE

CERTIFICATE OF CORRECTION

PATENT NO. : 4,995,142

DATED : February 26, 1991

INVENTOR(S) : ROLF BINDER, et al

It is certified that error appears in the above-identified patent and that said Letters Patent is hereby corrected as shown below:

Column 2, line 59 "contains: a" should be -contains a-

Signed and Sealed this

First Day of September, 1992

*Attest:*

DOUGLAS B. COMER

*Attesting Officer*

*Acting Commissioner of Patents and Trademarks*